United States Patent [19]

Lucas et al.

[11] Patent Number: 4,753,621

[45] Date of Patent: Jun. 28, 1988

[54] INFLATABLE LIFEJACKET

[75] Inventors: Kenneth C. Lucas, Godalming; Iain Logan, Bordon, both of England

[73] Assignee: RFD Limited, Surrey, England

[21] Appl. No.: 22,252

[22] Filed: Mar. 5, 1987

[30] Foreign Application Priority Data

Mar. 7, 1986 [GB] United Kingdom ..... 8605655

[51] Int. Cl.[4] ..... B63C 9/16

[52] U.S. Cl. ..... 441/117; 441/118; 441/123

[58] Field of Search ..... 441/106–118, 441/123, 129

[56] References Cited

U.S. PATENT DOCUMENTS

| | | | |
|---|---|---|---|
| 1,297,270 | 3/1919 | Stebbing | 441/118 |
| 1,517,469 | 12/1924 | Smith | 441/123 |
| 1,938,610 | 12/1933 | Robertson | 441/118 |
| 3,056,980 | 10/1962 | Holladay | 441/129 |

FOREIGN PATENT DOCUMENTS

| | | | |
|---|---|---|---|
| 771575 | 4/1957 | United Kingdom | 441/123 |

*Primary Examiner*—Sherman D. Basinger

*Attorney, Agent, or Firm*—Birch, Stewart, Kolasch & Birch

[57] ABSTRACT

An inflatable lifejacket for providing buoyancy in water to a wearer of the lifejacket includes an inflatable buoyancy envelope which is donned by a wearer who passes his head through a neck opening in the envelope to bring a main body portion of the envelope to overlie the chest with a neck portion of the envelope passing round the sides and back of the neck and resting on the shoulders. The neck portion of the envelope is formed by two inflatable neck sections extending upwardly from the main body portion at each side thereof and at their upper ends being connected together in the region of the back of the neck of the wearer by constraining straps which hold the upper ends together in a manner which permits spacing of them when the envelope is uninflated to provide a neck opening through which the wearer can pass his head but which so constrains the two ends when the envelope is inflated as to define a neck opening which obstructs passage of the wearer's head. Additionally, the main body portion of the envelope is constrained in a region between its upper edge and its lower edge to reduce the radius of curvature of the envelope at its upper edge when the envelope is inflated.

7 Claims, 3 Drawing Sheets

INFLATABLE LIFEJACKET

Figure 1:
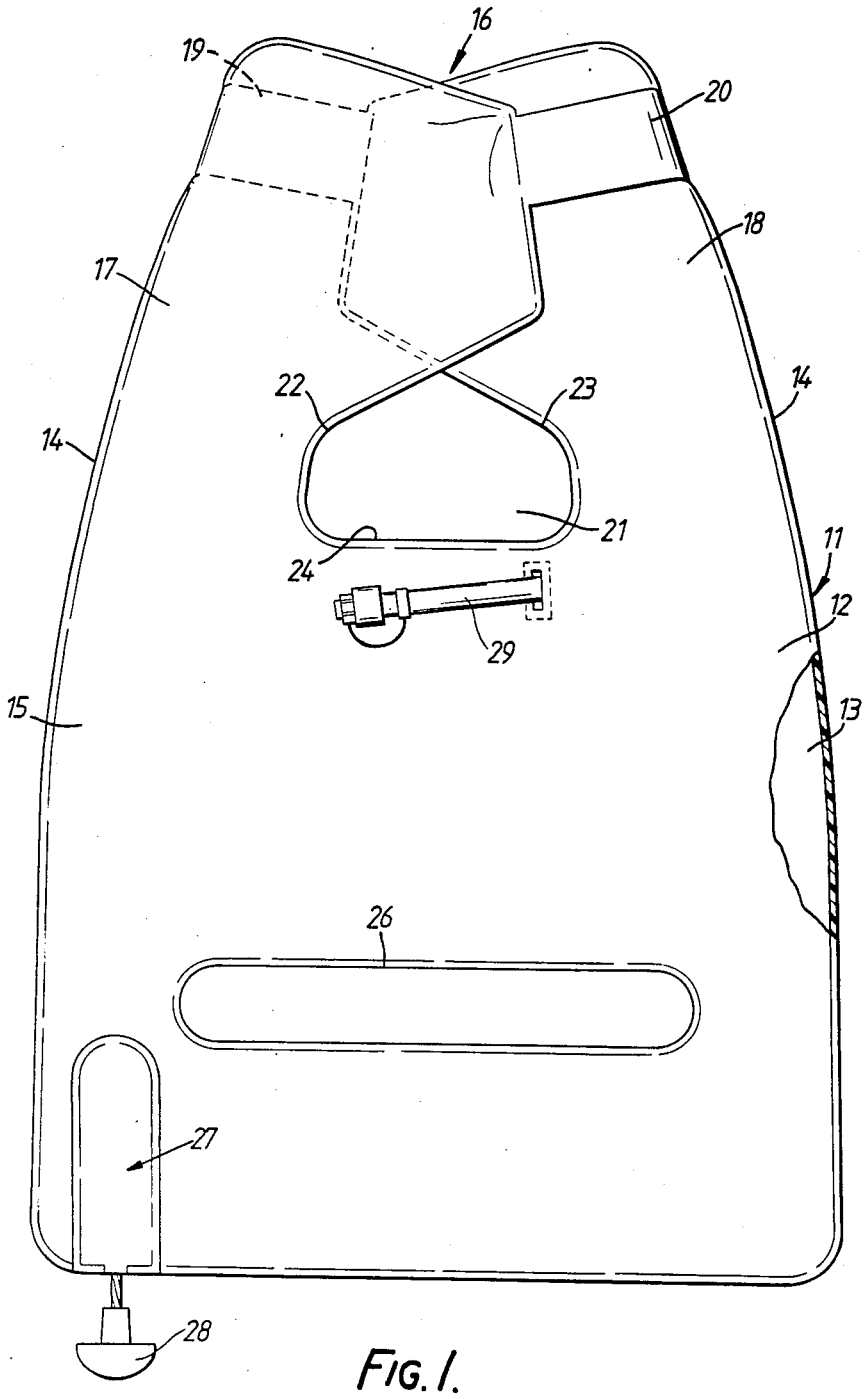

The present invention relates to an inflatable lifejacket which provides buoyancy in water to a wearer of the lifejacket. The lifejacket comprises an inflatable buoyancy envelope which is donned by the wearer who passes his head through a neck opening in the envelope to bring a main body portion of the envelope to overlie the chest with a neck portion of the envelope passing round the sides and back of the neck and resting on the shoulders.

In known inflatable lifejackets, a neck portion is provided which extends upwardly from the main body portion on one side of the lifejacket, passes around the back of the neck of the wearer and extends downwardly to the other side of the main body portion. The neck portion together with the upper edge of the main body portion define a neck opening which is of a fixed circumferential length and which is of a size to permit the wearer of the lifejacket to pass his head through it. While providing an opening of sufficient circumferential length for passage of the head, the neck portion must additionally ensure a secure fit around the neck of the wearer upon inflation. It is considered desirable and sometimes it is a requirement to ensure a fit around the neck which will prevent the neck portion of the lifejacket from slipping over the head under specific test conditions, in which for example the wearer is required to make a ten foot jump into water with the lifejacket inflated. While inflation of the neck portion of the conventional lifejacket does provide rigidity to the neck opening sufficient to offer resistance to displacement of the neck portion during a jump into water, displacement can occur. Efforts have been made to reduce the risk of displacement by modification of the lifejacket in the region of the neck opening.

In British Patent Specification No. 1601947, spaced fabric straps are provided which extend vertically over the neck opening from the upper edge of the inflatable neck portion down to the upper edge of the inflatable main body portion. In an uninflated condition, the lifejacket is donned by the wearer pushing his head through the neck opening and also through the opening between the fabric straps, the straps being readily displaced with the lifejacket in the uninflated condition. The wearer then inflates the lifejacket. When the neck portion inflates it tensions the fabric straps which then serve to prevent the wearer's head from slipping back through the neck opening.

It is an object of the present invention to provide an inflatable lifejacket of an alternative form which reduces substantially the risk that the neck portion of the inflated lifejacket will slip over a wearer's head upon a jump into water.

According to a first aspect of the present invention, there is provided an inflatable lifejacket for providing buoyancy in water to a wearer comprising an inflatable buoyancy envelope which is donned by a wearer who passes his head through a neck opening in the envelope to bring a main body portion of the envelope to overlie the chest with a neck portion of the envelope passing round the sides and back of the neck and resting on the shoulders. The neck portion of the envelope is formed by two inflatable neck sections extending upwardly from the main body portion at each side thereof and at their upper ends being connected together in the region of the back of the neck of the wearer by connecting means which hold the upper ends together in a manner which permits spacing of them when the envelope is uninflated to provide a neck opening through which the wearer can pass his head but which so constrains the two ends when the envelope is inflated as to define a neck opening which obstructs passage of the wearer's head.

The connecting means may comprise one or more constraining straps, the strap or each of the straps extending from a point on one of the neck sections to a point on the other of the neck sections in the regions of the upper ends thereof and preferably the strap or one or each of the straps is arranged to extend in a path over an inflatable portion of one or other or of each of the neck sections.

In an embodiment of the invention hereinafter to be described two constraining straps are provided, one of which extends from the inner edge of a first of the two neck sections to the outer edge of a second of the neck sections in a path across an inflatable portion of that neck section and along the front of the envelope, and the other of which extends from the inner edge of the second of the two neck sections to the outer edge of the first of the two neck sections in a path across an inflatable portion of that neck section and along the rear of the envelope.

Preferably, the constraining straps are such as to hold the upper ends of the neck sections in an overlapping relationship when the envelope is inflated. In addition, a further constraining strap may be connected between the two inner edges of the neck sections in the regions of the upper ends thereof to prevent displacement of the two neck sections beyond predetermined limits.

To reduce manufacturing costs, it is now a common practice to construct a buoyancy envelope from two sheets of a plastic material which overlie each other and which are seam welded together to form the envelope outer edge and the neck opening edge. It, however has long been recognized that stresses set up at the joined edges of the material place limitations on the ultimate burst pressure which can be sustained by the lifejacket. A burst pressure of 10 p.s.i. minimum is demanded, for example, to ensure that the lifejacket does not burst should it first be orally inflated and then subsequently inflated by an accidental discharge of the pressurised gas cylinder of the inflation unit used for automatic inflation. It can be shown that the stress in the material at a joint, for example at the joint provided at the neck opening of the lifejacket, is proportional to the product of the internal pressure of the envelope and the radius of curvature of the material at the joint. In prior British Specification No. 1601947 an attempt has been made to alleviate the problem at the neck opening by providing in the region of the front of the neck a longer horizontal neck seam, which reduces the resultant hoop stress.

It is an object of the present invention to provide in an inflatable lifejacket alternative or additional means whereby the hoop stresses at the joints at the front of the neck opening are reduced.

According to a second aspect of the present invention there is provided an inflatable lifejacket for providing buoyancy in water to a wearer of the lifejacket comprising an inflatable buoyancy envelope which is donned by a wearer who passes his head through a neck opening in the envelope to bring a main body portion of the envelope to overlie the chest with a neck portion of the envelope passing around the sides and back of the neck and resting on the shoulders. An an upper edge of the main body portion of the envelope defines a lower part of the neck opening, and the main body portion of the envelope is constrained in a region between the upper edge of the main body portion and its lower edge to reduce the radius of curvature of the envelope at the upper edge of the main body portion when the envelope is inflated.

In an embodiment of the invention according to its second aspect the upper edge of the main body portion of the envelope defining the lower part of the neck opening extends generally in a straight line across the lifejacket and the envelope is constrained along a line parallel thereto. Furthermore, where the envelope is formed by sheets of a flexible material which overlie each other and which are seam welded together to form the envelope edge, the envelope sheets are joined together in an intermediate region of the main body portion of the envelope by welding.

Figure 2:
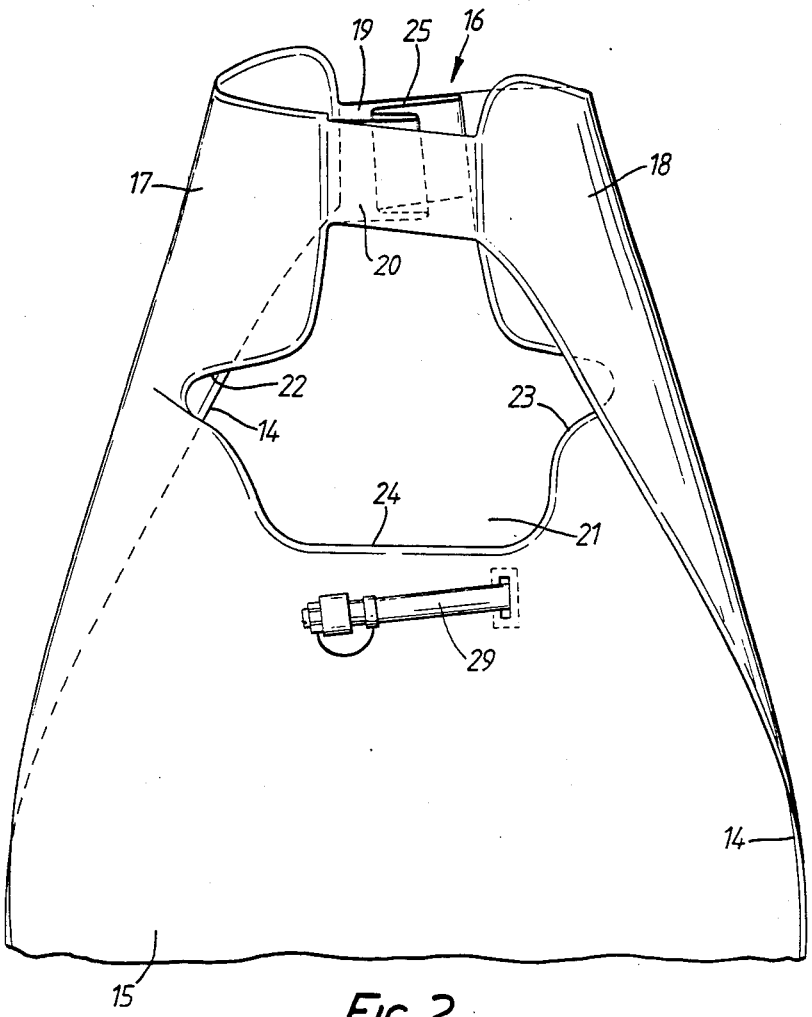
Figure 3:
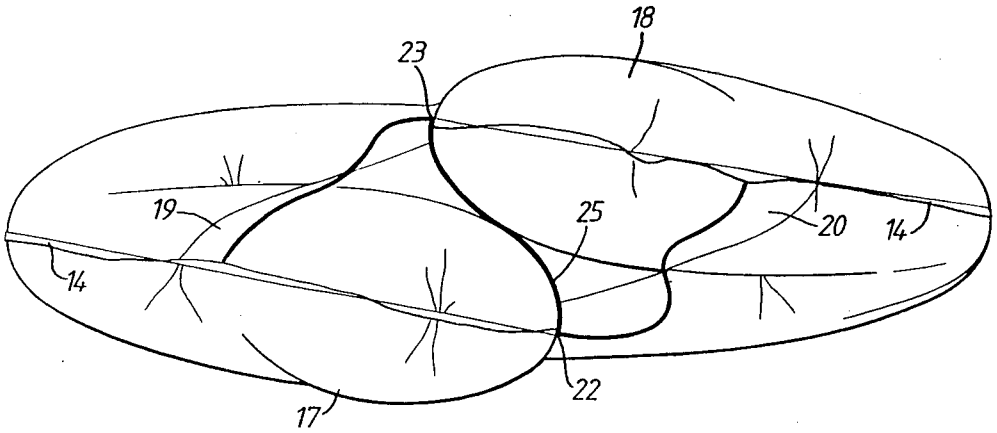

One embodiment of the invention will now be described by way of example with reference to the accompanying drawings in which:

FIG. 1 is a schematic front elevational view of a buoyancy envelope of a lifejacket according to the first and second aspects of the present invention, with the envelope uninflated and lying flat and undisplaced, FIG. 2 is a schematic front elevational view of part of the uninflated buoyancy envelope shown in FIG. 1, displaced to facilitate donning of the lifejacket by passage of the wearer's head through an enlarged neck opening, and FIG. 3 is a schematic end view of the buoyancy envelope shown in FIG. 1 with the buoyancy envelope inflated.

Referring to FIG. 1, a buoyancy envelope 11 is formed by two impermeable sheets 12 and 13 of a plastic coated material which overlie each other and which are joined together along their edges by welding in a single hit operation to form an envelope edge 14 having the continuous contour shown in FIG. 1. As will be seen, the envelope 11 comprises an inflatable main body portion 15 and a neck portion 16 formed by two inflatable neck sections 17 and 18 which overlap each other as shown and which are connected together by two constraining straps 19 and 20. As will be seen, the constraining strap 20 extends from the inner edge of the neck section 17 to the outer edge of the neck section 18 while the constraining strap 19 extends from the inner edge of the neck section 18 to the outer edge of the neck section 17. The neck sections 17 and 18 in their overlapping disposition as shown in FIG. 1 define a neck opening 21, which is bounded by an inner edge 22 of the neck section 17, an inner edge 23 of the neck section 18 and an upper edge 24 of the main body portion 15 of the envelope.

Although the neck opening 21 shown in FIG. 1 is of a small dimension, it can be enlarged substantially when the envelope is in the uninflated condition by displacing the two neck sections 17 and 18 from their overlapping disposition as shown in FIG. 1 to a spaced disposition as diagrammatically illustrated in FIG. 2. The disposition of the sections 17 and 18 in FIG. 2 as well as the disposition of the two constraining straps 19 and 20 is shown in simplified form for the purpose of illustration and it should be recognised that the configuration would vary from that shown depending upon the way in which the lifejacket is donned by a wearer. If the wearer first uses his hands to enlarge the neck opening 21 without applying considerable outward loading on the two sections 17 and 18, the neck sections 17 and 18 would take up dispositions approximating that shown in the simplified form in FIG. 2. Where however the wearer simply pushes his head through the neck opening 21, a configuration intermediate between that shown in FIG. 1 and that shown in FIG. 2 would develop depending upon the size of opening required for passage of the wearer's head. Clearly, the neck opening 21 as shown in FIG. 1 is substantially enlarged by moving the overlapping neck sections 17 and 18 from their overlapping disposition to the spaced disposition shown in FIG. 2. Once the uninflated lifejacket has been donned, the two neck sections 17 and 18 come to rest on the shoulders of the wearer and the two ends which extend around the back of the neck of the wearer return to their overlapping disposition as shown in FIG. 1. Upon inflation of the envelope 11, the upper ends of the two neck sections 17 and 18 are held in their overlapping disposition by the two straps 19 and 20 as best seen in FIG. 3.

Referring to FIG. 3, while it will be apparent that the two straps 19 and 20 prevent the neck sections 17 and 18 from moving apart in a plane parallel to the principal plane of the envelope, the two neck sections 17 and 18 would in the absence of further constraint have a freedom to move over each other. To impose a limitation on such movement a further constraining strap 25 is provided, which extends from the inner edge 22 of the neck section 17 to the inner edge 23 of the neck section 18.

It will be apparent that the donned buoyancy envelope 11 when inflated provides a neck opening which can be substantially smaller than the opening required for passage of the wearer's head. Furthermore, when the lifejacket is donned and inflated the wearer's neck is enclosed entirely by inflatable portions of the envelope 11 which provide good cushioning support for the head and offer considerable resistance to displacement of the neck portion of the envelope when a wearer is required to jump into the water from a considerable height of, for example, ten feet above the water.

With some lifejackets, a backstrap is provided to hold the neck portion of the lifejacket in place on the wearer's shoulders, but the neck sections for such a lifejacket can nevertheless be provided in accordance with the invention to give added security.

The buoyancy envelope 11 as shown in FIG. 1 is constructed from sheets 12 and 13 of a plastic material which overlie each other and which are seam welded to form the envelope outer edge 14, the inner edges 22 and 23 of the two neck sections 17 and 18 and the upper edge 24 of the main body portion 15. To reduce the stress imposed upon the edge 24 which partly defines the neck opening 21, the two envelope sheets 12 and 13 are seam welded together in an intermediate region of the main body portion 15 along a welding line 26, which has the effect of reducing the radius of curvature of the sheets 12 and 13 at the joint along the upper edge 24. With the aim of reducing the stress placed upon the joint along the upper edge 24 at the neck opening 21, the edge 24 is furthermore arranged to be substantially straight throughout most of its length and to achieve optimum reduction in stress along this edge the welding line 26 extends in a direction parallel to it.

The buoyancy envelope 11 illustrated in the drawings includes a pressurised gas inflation unit 27 including a conventional pressurised gas cylinder (not shown) which can be operated to inflate the envelope by pulling on a release tab 28, a topping-up tube 29 for oral topping-up of the envelope and conventional waist straps (not shown) for tying around the wearer's waist to hold the main body portion of the envelope against the wearer's chest. The envelope 11 would furthermore be provided with accessories (not shown), such as a lamp mounted at the edge of the envelope and supplied from a battery also secured to the edge of the envelope and a whistle removably secured also at the edge and additionally held by a cord. It is common practice for a lifejacket to be so constructed as to be reversible, that is to say, that it can be donned by a wearer so as to overlie the chest either way around In this event all the facilities on it would be arranged to be equally accessible with the envelope either way around and duplicated where necessary to achieve this end.

In the embodiment of the invention hereinbefore described a single inflatable envelope is provided by welding together two sheets 12 and 13 of a plastic material. It is, however, sometimes necessary to meet a requirement by an authority to provide a dual buoyancy chamber lifejacket in which two buoyancy envelopes are formed each with its separate inflation unit. To provide the further envelope, a third sheet of a plastic material is employed which overlies the other two sheets and the three sheets are seam welded together in a single operation to produce the two inflatable envelopes.

We claim:

1. An inflatable lifejacket, comprising:

an inflatable envelope having a neck opening formed therein, a neck portion, and a main body portion so that the head of a wearer of said lifejacket can pass his head through said neck opening to place said main body portion in contact with the chest of the wearer and said neck portion passes around the sides and back of the neck of the wearer and rests on the wearer's shoulders;

said neck portion including;

two inflatable neck sections extending upwardly from said main body portion at each side thereof, and at their upper ends being connected together in a region of the back of the neck of the wearer by connecting means, said connecting means including first and second constraining straps for holding said upper ends of said two inflatable neck sections together to permit spacing of them when said envelope is uninflated to provide said neck opening through which the wearer can pass his head but which constrains the two end so that said neck sections, when inflated, form a neck opening which obstructs passage of the wearer's head, the first strap being connected at one end to a point on the upper end of one neck section and at the other end to a point on the upper end of the other neck section and extending between its two ends in a path across an inflatable portion of the other neck section and to the front of the envelope, and the second strap being connected at one end to a point on the upper end of the other neck section and at the other end to a point on the upper end of said one neck section and extending between its two ends in a path across an inflatable portion of said one neck section and to the rear of said envelope.

2. The lifejacket according to claim 1, wherein said first constraining strap is connected to an inner edge of the upper end of said one neck section and an outer edge of the upper end of said other neck section and said second constraining strap is connected to the inner edge of the upper end of said other neck section and the outer edge of the upper end of said one neck section.

3. The lifejacket according to claim 2, wherein the constraining straps hold the upper ends of the neck sections in an overlapping relationship when the envelope is inflated.

4. The lifejacket according to claim 3, wherein the connecting means includes a further constraining strap connected between the two inner edges of the neck sections in the regions of the upper ends thereof to prevent displacement of the two neck sections beyond predetermined limits.

5. A lifejacket according to claim 1, wherein an upper edge of the main body portion of the envelope defines a lower part of the neck opening and wherein the main body portion of the envelope is constrained in a region between the upper edge of the main body portion and its lower edge to reduce the radius of curvature of the envelope at the upper edge of the main body portion when the envelope is inflated.

6. The lifejacket according to claim 5, wherein the upper edge of the main body portion extends generally in a straight line across the lifejacket and wherein the envelope is constrained along a line parallel thereto.

7. The lifejacket according to claim 5, wherein the envelope is formed by first and second sheet portions of a flexible material which overlie each other and which are seam welded together to form the envelope edge and wherein the envelope sheet portions are joined together in an intermediate region of the main body portion of the envelope by welding.

* * * * *